US007389599B2

(12) United States Patent
Hishinuma et al.

(10) Patent No.: US 7,389,599 B2
(45) Date of Patent: Jun. 24, 2008

(54) SYSTEM AND METHOD FOR PROVIDING ACCESS TO EQUIPMENT IDENTITY INFORMATION

(75) Inventors: David S. Hishinuma, Fremont, CA (US); Ken G. Robertson, San Jose, CA (US); Dustin Rosing, Sunnyvale, CA (US); Richard W. Davis, San Jose, CA (US); Harold Miyamura, San Jose, CA (US); Jorge E. Rocabado, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 883 days.

(21) Appl. No.: 10/365,258

(22) Filed: Feb. 12, 2003

(65) Prior Publication Data

US 2004/0154197 A1 Aug. 12, 2004

(51) Int. Cl.
*B42F 17/34* (2006.01)

(52) U.S. Cl. ..... 40/375; 40/491; 40/649

(58) Field of Classification Search ..... 40/375, 40/491, 649, 633
See application file for complete search history.

(56) References Cited

U.S. PATENT DOCUMENTS

| | | | | |
|---|---|---|---|---|
| 2,968,110 | A * | 1/1961 | Quarnstrom | 40/336 |
| 5,700,051 | A | 12/1997 | Newhouse | |
| 5,997,080 | A | 12/1999 | Newhouse et al. | |
| 6,186,552 | B1 * | 2/2001 | Seabrook | 281/45 |
| 6,431,512 | B1 * | 8/2002 | Fox et al. | 248/286.1 |
| 6,532,691 | B2 * | 3/2003 | Carlin et al. | 40/491 |
| 2003/0163940 | A1 * | 9/2003 | Mautz | 40/661.11 |

OTHER PUBLICATIONS

Definition of server, Webopedia, www.webopedia.com.*

* cited by examiner

*Primary Examiner*—Joanne Silbermann

(57) ABSTRACT

In one embodiment, there is shown a system and method of allowing a user to gain access to information pertaining to certain equipment by pulling a label out of an opening in a surface of the equipment, viewing information on the label; and pushing the label back into the opening. In a further embodiment, the label is captive to the equipment independent from a bezel surrounding the equipment. In a still further embodiment of the invention, the label has on it pre-established information pertaining to the equipment, as well as user added information.

5 Claims, 3 Drawing Sheets

SYSTEM AND METHOD FOR PROVIDING ACCESS TO EQUIPMENT IDENTITY INFORMATION

BACKGROUND

In complex equipment, such as, for example, computer servers and the like, it is often necessary for a user to obtain information about the equipment and/or the version of software loaded on the equipment. For example, with respect to a processor or server, the user often needs to know the serial number, or the IP address, or the product ID, or other information. Some of this information is constant in that once the equipment is put into the housing its identity remains fixed. Other identifications, such as, for example, the version of the current operating system or the version of one or more applications, is temporal and changes more frequently. Also, in some situations, a user may desire to keep track of prior versions (heritage) of the equipment and/or programs running on the equipment.

Currently, there are different methods that a user employs to obtain the desired information, with the particular method employed depending upon whether the desired information is relatively permanent or temporal. For permanent information pertaining to a particular piece of equipment, the user usually must look behind the equipment for the serial number, model number and other such information. This, at best, is inconvenient and sometimes relatively difficult to achieve, given the wiring that is typically found behind a processor. The space constraints also limit a user's ability to retrieve equipment information which is located in the rear of the equipment. Pulling equipment away from walls, or pulling racks out to see behind the equipment is cumbersome and often interferes with the proper operation of the equipment.

The problem is different with temporal information since there is no convenient place to maintain a record of software version, or IP address or other network information. Some people use notebooks, some note cards, some scraps of paper. In some instances, users mark the current versions on the equipment with various markers and/or 'sticky' notes. In addition to the haphazard nature of such "solutions" they have a serious problem when equipment is changed out. In such situations, it is common to remove the front bezels from the equipment and since often the bezels interchangeable, such that when the bezels are returned to the equipment they are not associated with the same device as they were before removal. Thus, the information pertaining to the device which are on the bezel is now improper.

SUMMARY

In one embodiment there is shown a system and method of allowing a user to gain access to information pertaining to certain equipment by pulling a label out of an opening in a surface of the equipment, viewing information on the label, and pushing the label back into the opening. In a further embodiment of the invention, the label is captive to the equipment. In a still further embodiment of the invention, the label has on it pre-established information pertaining to said equipment, as well as user-added information.

In one embodiment there is shown a device for attachment to equipment, where the device has a label operative for moving in and out of a bezel surrounding the equipment, the label having a flat surface on which information can be displayed, and having a stop operative when the label is pulled out of the device for preventing the label from coming free of the device, the stop arranged so that a user may view information displayed on the label.

DETAILED DESCRIPTION

Figure 1:
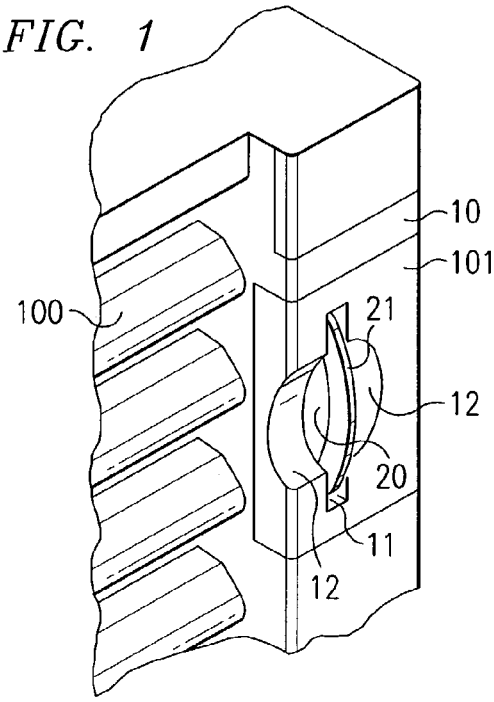
FIG. 1 is a front perspective view of a server showing one embodiment of the invention.

FIG. 1 illustrates one embodiment of the system and method of the invention. Label 20 is shown in the closed (pushed-in) position within bezel 10. Bezel 10, in turn, is mounted on a surface of equipment 100 visible to the user while the equipment is in operation. Label 20 is, in the embodiment shown in FIG. 1, mounted within bezel 10, which has formed therein indentions 12 on either side of label pull 21. The indentions may be used advantageously so that a users fingers may grip either side of label pull 21 while label 20 is in the closed position so as to allow the user to pull label 20 out from bezel 10 via slot 11. When label 20 is pulled out, information which has been positioned and on either side of the label becomes visible to the user.

Bezel 10 is constructed so that when it is removed from equipment 100, label 20 (and its slide support structure) remains attached to the equipment 100 so that the information remains correct regardless of which bezel is positioned around equipment 100. Bezel portion 101 can be manufactured as part of bezel 10, or portion 101 can be manufactured as a separate part and attached to bezel 10 in a desired location. This later procedure is helpful to reduce overall tooling costs when different size bezels are used since all of ports 101 can be made the same regardless of the size of the bezel.

Figure 2:
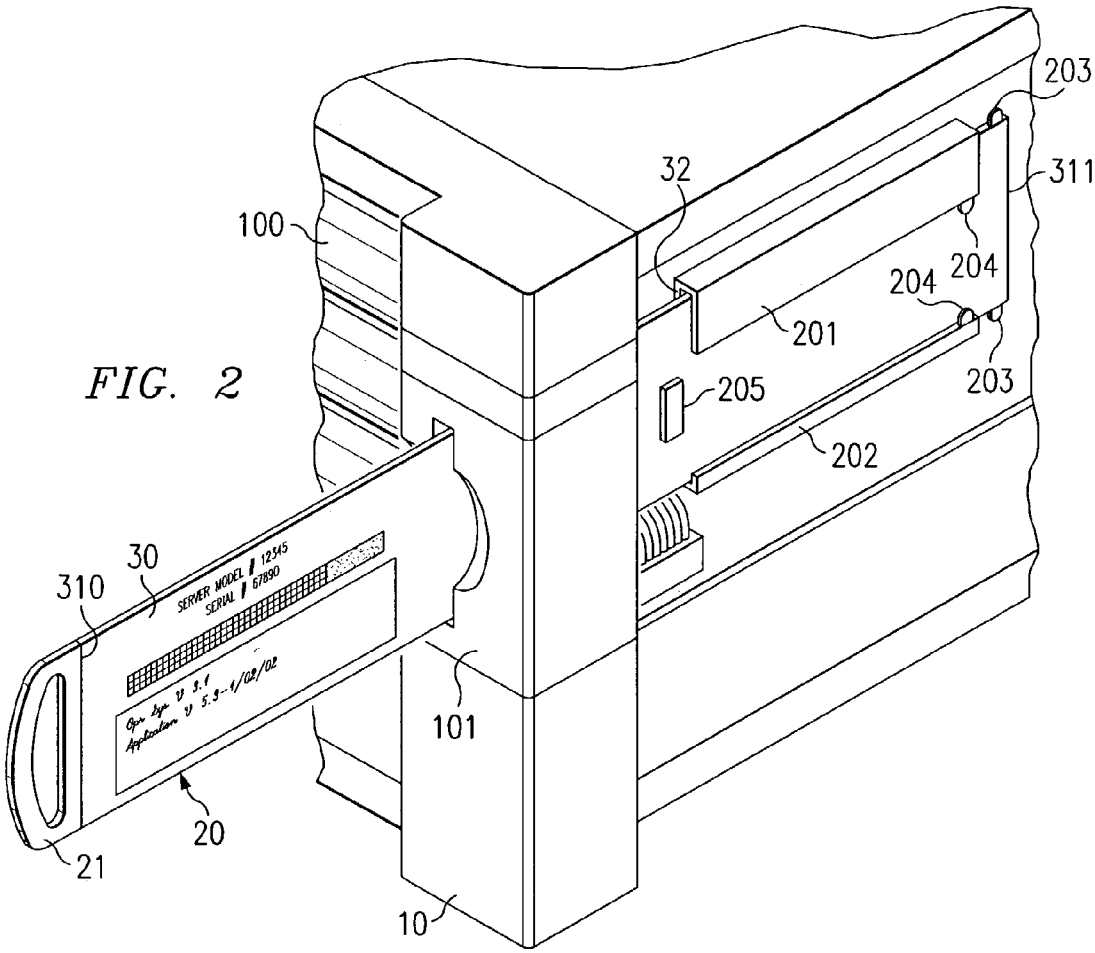
FIG. 2 is a side perspective view of the server shown in FIG. 1 with a side panel of the server removed and the label pulled out.

FIG. 2 shows label 20 in the outward, or pulled-out position, thereby exposing flat surfaces 30 which have a proximal end 310 advantageously (if desired) attached to pull-handle 21. Label 30 also has distant end 311, which remains in the embodiment within equipment 10. Sides 30, which in the embodiment are flat, can be marked upon as will be discussed. Note that either, or both, sides 30 of label 20 may be used for positioning information pertaining to equipment 100.

In the embodiment shown, slides 201 and 202 (which are part of label 20's support structure 32) are used to position label 20 and to facilitate easy in-out movement. Tabs 203 press against slides 201, 202 when label 20 is pulled out so as to prevent label 20 from being pulled so far out of the bezel that it falls out. When label 20 is pushed in, tab 205 pushes against tabs 204 to maintain the outside (proximal) end of handle 21 flush with the outer surface of equipment 100 (FIG. 1).

Advantageously, label 20 is made from polycarbonate material and will have dimensions of approximately 20 mm×225 m×0.5 mm and will pull out to expose approximately 100 mm (label application area) of surface 300. These dimensions can be adjusted as necessary.

Label 20 support structure 32 is mounted to equipment 100 (or to the frame which houses equipment 100) such that when bezel 10 (including, if desired, portion 101) is removed from equipment 100, the label and its support structure will remain in position.

Figure 3A:
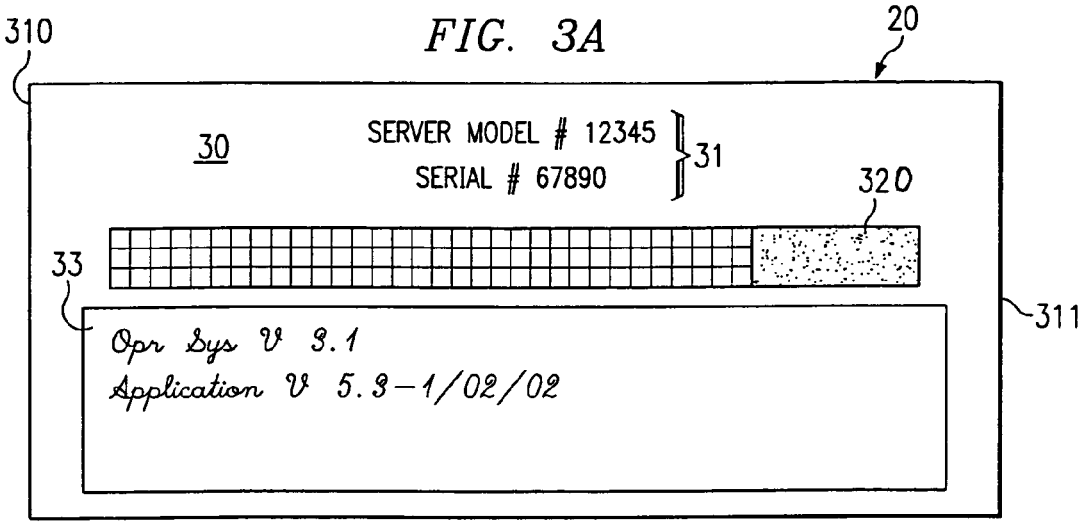
FIGS. 3A and 3B are two examples of the label surface of one embodiment of the invention.

FIG. 3A shows one embodiment of label 20 having information, such as, for example, information 31 fixed permanently. Other information can be positioned on a hook-loop type surface 320 which is adapted for receiving reusable numbers and/or letters (alpha numerics). Information area 33 is an area of label 20 which allows a user to mark information thereupon. The marked information can be permanent or removable, as desired. Area 33 can be the same material as the remainder of label 30 or it can be a writable surface.

Figure 3B:
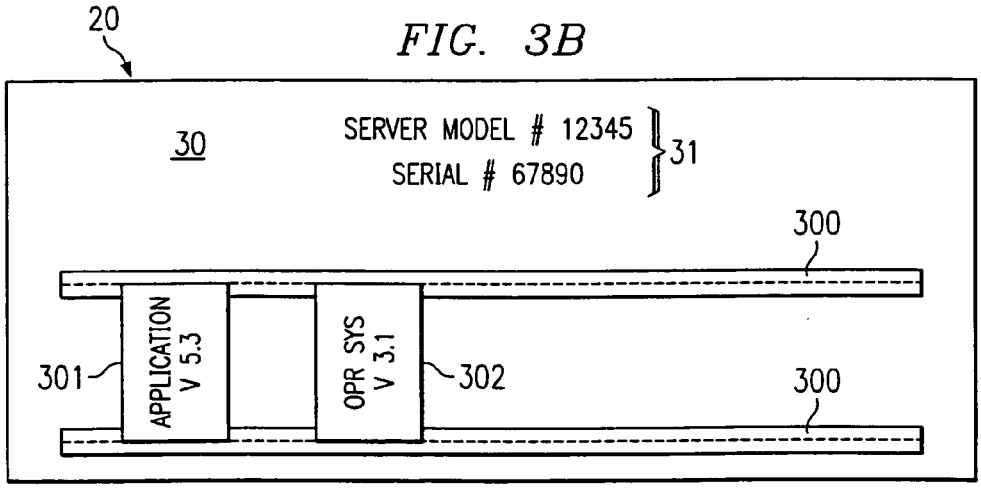

FIG. 3B shows one alternative embodiment where information tags 301 and 302 can be positioned temporarily between slides 300, which slides, in turn are mounted on surface 30 of label 20. This will allow the information to have a more "official" look, but still changeable by the user.

Figure 4:
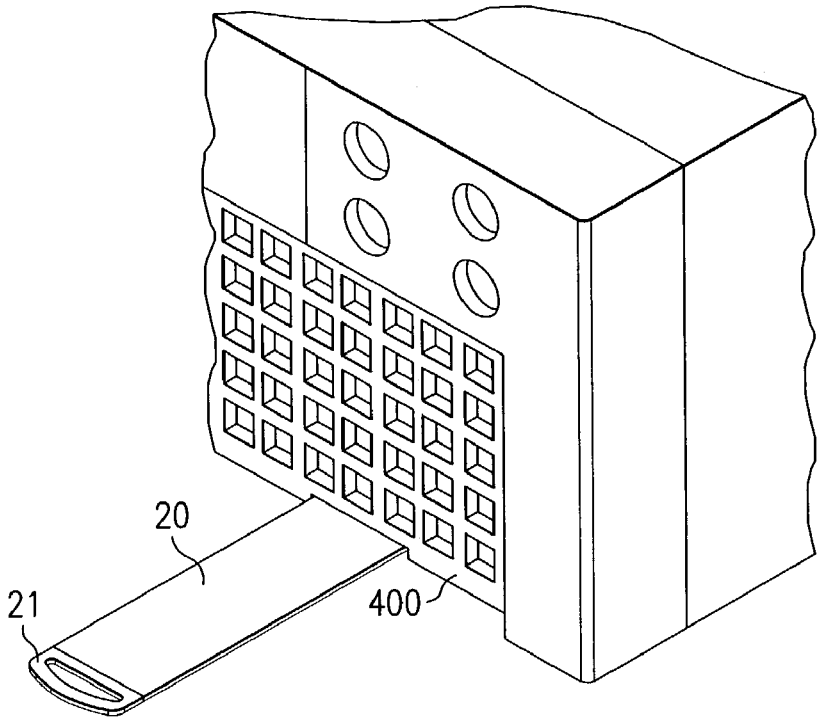
FIG. 4 shows an alternate placement of the label, with the label pulled out.

FIG. 4 shows one alternate placement where label 20 is positioned at the bottom of a visible surface of equipment 400. In FIG. 4 label 20 is shown pulled-out.

Figure 5:
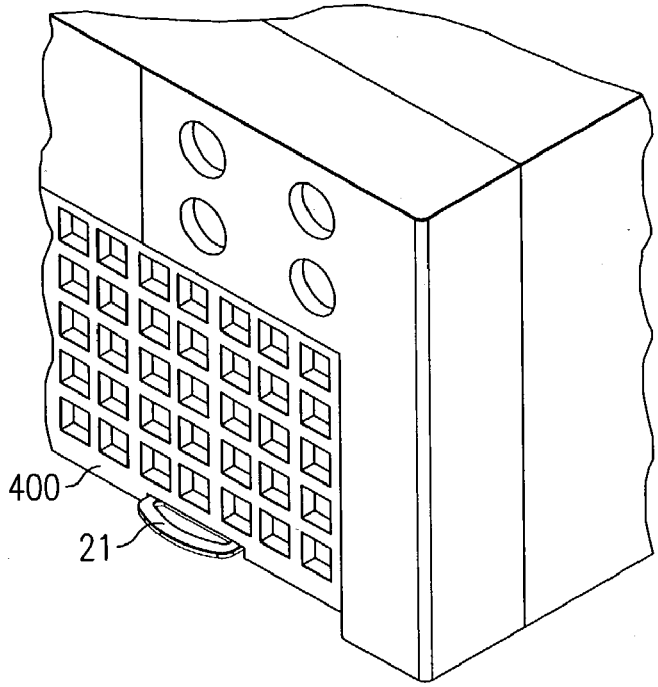
FIG. 5 shows the embodiment of FIG. 4 with the label retracted.

FIG. 5 shows the label placement of FIG. 4, but in the closed, or pushed-in, position.

Note that the position of the label on the equipment is not critical, providing the label is visible to a user when pulled out from bezel 10. Label 20 could be used on the back (wiring) side of the equipment as well as either side of the equipment. Also, the proximal end of handle pull 21 need not be mounted flush with the surface of equipment 400.

What is claimed is:

1. A label for use in computer equipment having a bezel, said bezel adapted for removable attachment to a surface of said computer equipment, said surface being accessible by a user during operation of said computer equipment without moving said computer equipment, said label comprising:

a distal portion and a proximal portion;

a flat surface formed between said distal and proximal portions, said flat surface adapted for displaying material to a user when said label is pulled out of said bezel;

said label proximal portion including a pull, said pull operative for assisting a user in pulling said label out of said bezel a distance to allow said user to view material on said label;

said label having a sleeve for controlling the maximum travel of said label distal portion relative to the front surface of said bezel; and wherein said label remains coupled to said computer equipment when said bezel is removed from said computer equipment.

2. The label of claim 1 wherein at least a portion of said flat surface is adapted for accepting markings from a user from time to time.

3. The label of claim 1 wherein said markings may be changed by said user.

4. The label of claim 1 wherein said label flat surface includes polycarbonate material.

5. The label of claim 1 wherein said label application area is approximately 20 mm×225 mm and is 0.5 mm thick.

* * * * *